US005214949A

United States Patent [19]

Cadwell

[11] Patent Number: 5,214,949

[45] Date of Patent: Jun. 1, 1993

[54] COLD WALL SUPERPLASTIC FORMING PRESS WITH SURFACE MOUNTED RADIANT HEATERS

[75] Inventor: Gilbert C. Cadwell, Lakeside, Calif.

[73] Assignee: Rohr, Inc., Chula Vista, Calif.

[21] Appl. No.: 863,957

[22] Filed: Apr. 6, 1992

[51] Int. Cl.[5] ..... B21D 26/02

[52] U.S. Cl. ..... 72/60; 72/342.94; 72/709

[58] Field of Search ..... 72/60, 61, 62, 342.94, 72/709; 29/421.1

[56] References Cited

U.S. PATENT DOCUMENTS 4,352,280 10/1982 Ghosh ..... 72/60
4,474,044 10/1984 Leistner et al. ..... 72/60
4,984,348 1/1991 Cadwell ..... 72/60

FOREIGN PATENT DOCUMENTS 0608588 5/1978 U.S.S.R. ..... 72/60
0700239 11/1979 U.S.S.R. ..... 72/62
0719753 3/1980 U.S.S.R. ..... 72/60

*Primary Examiner*—David Jones
*Attorney, Agent, or Firm*—Patrick J. Schlesinger; Frank D. Gilliam

[57] ABSTRACT

A vertically reciprocable lower chamber has a ceramic forming chamber surrounded by a steel reinforcing jacket. A fixed upper chamber includes a metal cover surrounded by ceramic insulator blocks and and an outer steel jacket. A horizontal foam ceramic platen inside the steel cover has a serpentine radiant heating coil attached to the flat underside thereof via inserted fasteners for more efficient heating of a metal sheet positioned horizontally between the upper and lower chambers. A plurality of foam ceramic insulator blocks have secondary heating coils attached to their inwardly facing surfaces for heating the peripheral edges of the metal sheet. This ensures a gas tight seal between the metal cover and the sheet.

20 Claims, 1 Drawing Sheet

COLD WALL SUPERPLASTIC FORMING PRESS WITH SURFACE MOUNTED RADIANT HEATERS

BACKGROUND OF THE INVENTION

The present invention relates to forming metal parts, and in particular, to an improved apparatus for forming a part from a Titanium sheet while it is in a superplastic state.

For many years it has been known that certain metals, such as Titanium and Aluminum, as well as alloys thereof, exhibit superplasticity within limited temperature ranges and strain rates. Superplasticity is the capability of a material to develop unusually high tensile elongations with a reduced tendency towards necking. Thus when in a superplastic condition, the metal or metal alloy exhibits low resistance to deformation and may be elongated with controlled thinning. This permits a sheet of such metal to be rapidly formed against dies to achieve desired shapes. Superplastic forming (SPF) may be performed in conjunction with diffusion bonding (DB). Diffusion bonding refers to a metallurgical joining of surfaces of similar or dissimilar metals by holding them in physical contact and applying heat and pressure sufficient to cause commingling of the atoms at the junction. See for example U.S. Pat. Nos. 3,934,441 of Hamilton et al.; 3,927,817 of Hamilton et al.; 4,984,348 of Cadwell; and 5,016,805 of Cadwell.

One conventional technique of SPF is known as diaphragm forming. A relatively large sheet of Titanium is laid horizontally across an upwardly opening steel forming chamber. The chamber is supported in a hydraulic or pneumatic press so that a steel cover can be closed against the chamber from above. The peripheral edges of the Titanium sheet are firmly clamped between the mating edges of the forming chamber and the cover which are provided with a peripheral seal. The sheet is then heated to the appropriate temperature and formed around a ceramic or steel die supported in the lower chamber. The heating is accomplished utilizing electrically powered radiant heating coils. The formation of the Titanium sheet around the die results from the introduction of a protective envelope of Argon gas on both sides of the sheet and the subsequent release of pressurized gas from beneath the sheet. See my U.S. Pat. No. 4,984,348 entitled SUPERPLASTIC DRAPE FORMING.

Heretofore the radiant heating coils in an SPF press have usually been supported by an upper ceramic platen carried by the upper steel cover of the press. By way of example, the coils may comprise helically wound strands of resistance type Nichrome wire. The coils may be approximately 0.30 inches in diameter, with a thirty watts per square inch heating density. Since the Titanium sheet must be heated to a temperature in the range of 1,600°-1,700° F., a significant amount of electrical energy is consumed.

Typically radiant heating elements used in SPF presses have been squeezed into slots formed in the surface of the ceramic platen. In some cases the radiant heating elements have been embedded in fiberous supports. In another design radiant heating coils have been supported between standoffs formed in the ceramic platen. Most often the radiant heating elements are supported above the Titanium sheet in close proximity thereto. Where radiant heating coils are used it is important that the coils not sag and contact the sheet. The problem with mounting the radiant coils in slots is that only a small portion of each coil is exposed for direct radiant heating, thus reducing the overall heating efficiency. Mounting the radiant coils on standoffs is a complex and fragile arrangement requiring that supporting ceramic rods be extended through the interior of each of the coils, reducing the overall heating efficiency. It would be desirable to provide a much more efficient manner of mounting the radiant heating coils in an SPF press.

Because of the high temperatures involved in SPF, the bottom wall of the steel chamber has had a tendency to bow, which sometimes results in fracturing of the ceramic die supported thereon. The chamber must be made of Chrome-Nickel steel to withstand high temperatures, but still ends up having a limited life. Replacing the chamber is both time consuming and costly. The outer walls of the steel chamber are thermally insulated and part of this insulation is provided by a water cooled jacket. The steel chamber has relatively thick walls to withstand internal pressure, and therefore a relatively large mass. This mass is heated by the aforementioned resistance type electrical heating elements inside the SPF press. Each time the press is opened, a tremendous amount of heat is lost, resulting in substantial additional electric power being consumed in order to maintain the high temperatures required. An SPF press having an entirely steel chamber may require approximately twenty four hours to bring up to 1600°-1700° and then to cycle back down to ambient temperature. If the heating could be made more efficient, this cycle time could be substantially reduced, resulting in tremendous energy savings. Also, if the press could be made more efficient, its external steel walls would be cool and would last longer before fatiguing.

My aforementioned U.S. Pat. No. 4,984,348 discloses an SPF press that utilizes an inner ceramic chamber surrounded by an outer steel jacket. The radiant heating coils are embedded in the upper ceramic platen of the press. While this press has demonstrated improvements in cycle time and energy efficiency, still further improvements in these parameters are desirable.

SUMMARY OF THE INVENTION

It is therefore the primary object of the present invention to provide an improved SPF press.

It is another object of the present invention to provide a more efficient construction for the heating elements in an SPF press.

My invention provides an improved apparatus for superplastic forming of a metal sheet, such as Titanium. It includes upper and lower chambers and a mechanism for opening and closing the chambers to form the metal sheet therebetween. The lower chamber includes a ceramic forming chamber surrounded by an outer metal jacket. The ceramic forming chamber has an upwardly opening interior for receiving and supporting a forming die. A horizontal metal apron surrounds the interior above an upwardly facing peripheral surface of the ceramic forming chamber. This metal apron serves as a sealing anvil. It also faciliates the stripping of formed parts from the die as the press opens. The upper chamber includes a downwardly opening metal cover having a plurality of side walls with lower horizontal edges that overlie the apron. These lower edges provide an impinging pressure seal. A ceramic platen is supported within an interior of the steel cover. A radiant heating coil is mounted on a flat underside of the ceramic platen. The steel cover is surrounded by ceramic insulation and incased in a metal jacket. At least one of the upper and lower chambers is vertically reciprocated to squeeze a plurality of peripheral edges of the metal sheet after it has been laid across the interior of the ceramic forming chamber between the apron and the horizontal edges of the metal cover. The radiant heating coil heats the metal sheet to a temperature at which it attains superplasticity. Pressurized gas, such as Argon, is pumped through the upper chamber into the interior of the metal cover to force the superplastic sheet over the forming die to thereby form the desired part.

According to a principal aspect of my invention, the ceramic heating platen is made of a foam ceramic material with a maximum density of approximately thirty pounds per cubic foot so that the radiant heating coil can be secured to the flat underside thereof with fasteners that are inserted into the foam ceramic material. This maximizes the amount of heat radiated from the coil to the metal sheet as nearly all of the energy can be reflected from the flat underside of the ceramic platen to the sheet.

According to another aspect of my invention, a plurality of second foam ceramic insulator blocks surround the metal cover adjacent the lower edges of the side walls of the metal cover. A plurality of second radiant heating coils are mounted to the inwardly facing surfaces of the second ceramic insulator blocks for heating peripheral edges of the metal sheet to insure a gas tight seal between the horizontal edges of the metal cover and the sheet.

DESCRIPTION OF THE PREFERRED EMBODIMENT

Figures 1, 2:
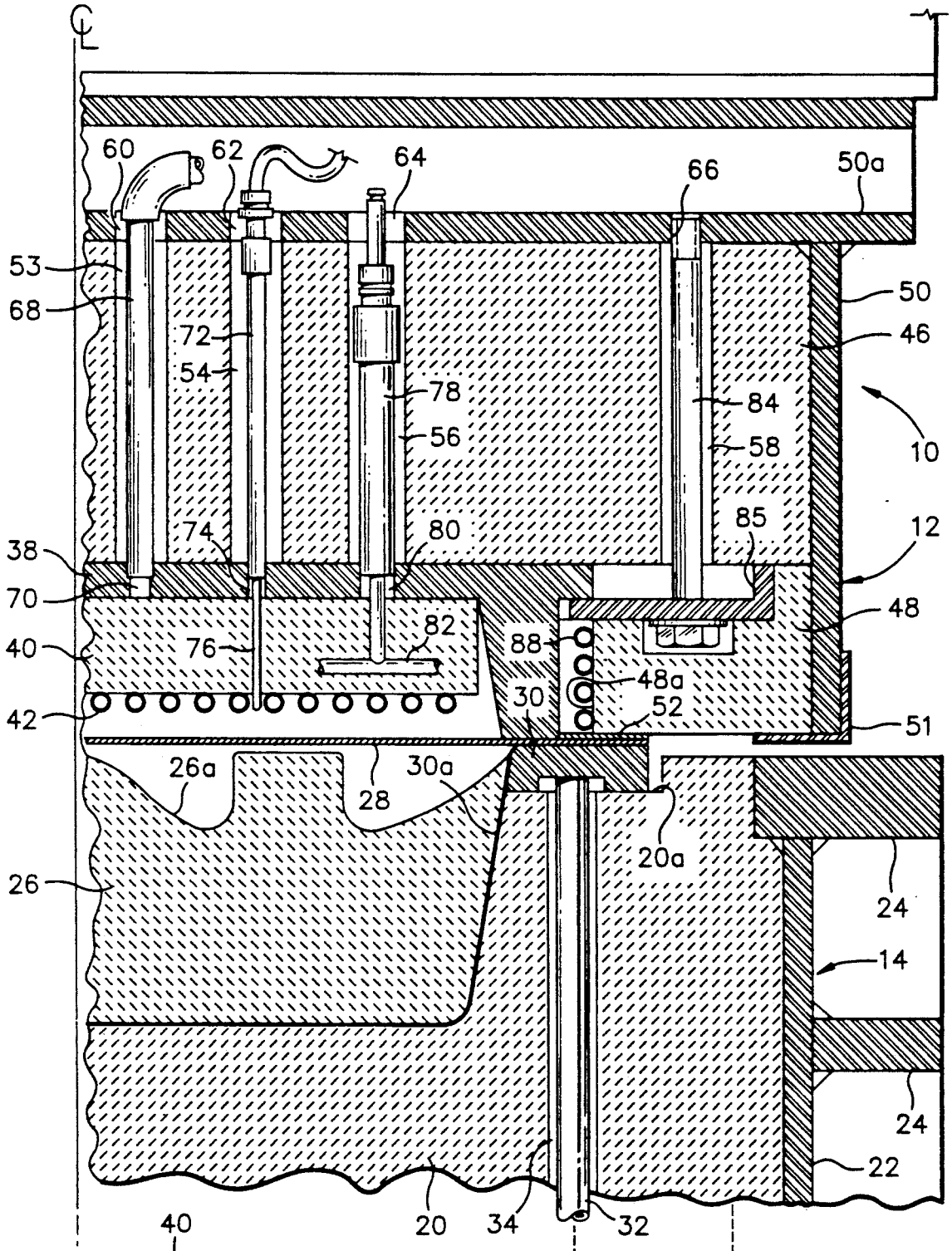
FIG. 1 is a fragmentary vertical sectional view of a cold wall SPF press constructed in accordance with a preferred embodiment of my invention. The pneumatic actuator, diaphragm and roll out bolster of the press are illustrated in functional block diagram form.
FIG. 2 is a greatly enlarged fragmentary sectional view of the ceramic heating platen of the press of FIG. 1 illustrating the manner in which a radiant heating coil is attached thereto.

Referring to FIG. 1, according to my invention, a cold wall SPF press 10 includes an upper chamber 12 and a lower chamber 14. The press may be opened by vertically reciprocating the lower chamber 14 via pneumatic diaphragm 16. The lower chamber 14 is supported by a roll out bolster 18 which may slide horizontally on air bearings or other rolling means on the support frame of the press (not illustrated). This facilitates the loading and unloading of Titanium sheet and formed parts as well as the replacement of the forming die. The upper chamber 12 is supported in a fixed position by a conventional frame (not illustrated).

The lower chamber 14 includes a hard ceramic forming chamber 20 supported by an outer steel jacket 22. The ceramic forming chamber 20 has great compressive strength and may consist of, for example, Calcium-Aluminate binder and fused Silica aggregate. Suitable ceramic material for this purpose is sold under the trademark THERMOSIL. The ceramic forming chamber 20 may be poured in place inside the jacket 22 and cured therein. The surrounding steel jacket 22 may be made of mild steel which supplies the great tensile strength lacking in the ceramic forming chamber 20. This tensile strength is further increased by surrounding steel reinforcing ribs 24 which are welded to the outside of the steel jacket 20. The ceramic forming chamber 20, steel jacket 22 and steel ribs 24 collectively form a pressure vessel.

A ceramic or steel forming die 26 is supported within an upwardly opening interior of the ceramic forming chamber 20. This ceramic forming die 26 is preferably made of the same hard ceramic material as the ceramic forming chamber 20. The configuration and dimensions of the bottom and side surfaces of the ceramic forming die 26 closely approximate those of the bottom wall and side walls of the upwardly opening interior of the ceramic forming chamber 20. Thus the die 26 fits snugly in the forming chamber 20. This arrangement is in contrast to the conventional SPF press wherein the ceramic forming die is much smaller than the interior of the lower forming chamber and is held in position by a suitable filler.

The upper surface **26*a* of the ceramic forming die 26 defines the contour of the part to be formed from an overlying Titanium sheet 28. The peripheral edges of the Titanium sheet 28 are supported on a horizontal rectangular steel apron 30. This steel apron is shaped like a picture frame and rests in an upwardly open recess 20*a* in the upwardly facing peripheral surface of the ceramic forming chamber 20. The inner edges 30*a* of the steel apron 30 are inclined and clear the side walls of the ceramic forming die 26. The upper surface of the apron 30** has a small raised rectangular projection (not illustrated) which forms an impingement pressure seal.

Vertical actuator rods such as 32 are mounted in vertical bores such as 34 in the ceramic forming chamber 20. The upper ends of these actuator rods engage the underside of the steel apron 30. The lower ends of these actuator rods are mechanically coupled to a short stroke pheumatic actuator 36 which can be used to lift the steel apron 30 after the lower chamber 14 has been lowered away from the upper chamber 12. This lifting of the steel apron 30 is used to pull the part formed from the Titanium sheet 28 away from the contoured surface **26*a* of the ceramic forming die 26. The apron 30, actuator rods 32 and pheumatic actuator 36** thus function as a part stripper.

The upper chamber 12 includes a downwardly opening steel cover 38. The lower horizontal edges of the side walls of the steel cover 38 overlie the peripheral edges of the Titanium sheet 28 and squeeze these edges against the impingement seal of the steel apron 30. A horizontal ceramic platen 40 is supported within the interior of the steel cover 38. A radiant heating element in the form of a coil 42 is mounted on the flat underside **40*a* of the ceramic platen 40. The heating coil is preferably one single continuous coil arranged in serpentine fashion. The cross-sectional view of FIG. 1 shows a plurality of segments of this serpentine coil. The ceramic platen 40** is made of a special lightweight foam ceramic material.

Fasteners such as staples 44 (FIG. 2) are pressed into the foam ceramic platen 40 in order to secure the coil 42 to the underside **40*a* thereof. These staples preferably have tapered edges which cause them to deflect outwardly upon insertion into the ceramic foam material. This outward spreading prevents the staples from working loose and allowing the radiant heating coil 42 to fall away from the ceramic platen 40. The staples 44 are preferably made of the same material as the coil 42**.

One suitable foam ceramic material is commercially available from CERADYNE. Preferably the foam ceramic material has a maximum density of approximately thirty pounds per cubic foot with 80% porosity. It has a compressive strength of approximately 600 PSI. This type of foam ceramic material is supplied by the manufacturer in blocks which may be sawed to the desired size. By mounting the radiant heating coil 42 to the underside 40*a* of the ceramic platen 40, the maximum amount of heat is radiated from the coil to the Titanium sheet 28. This greatly improves the heating efficiency of my press. The top wall of the steel cover 38 and ceramic platen 40 are dimensioned and configured in order to place the radiant heating coil 42 in close proximity to the Titanium sheet 28 when the upper and lower chambers 10 and 14 of the press are closed as illustrated in FIG. 1.

Prior to my invention, there was no way to readily mount a radiant heating element entirely outside the surface of a ceramic platen. No fasteners could be attached or bolted to the hard ceramic conventionally used for the platen. The use of formed ceramic standoffs or ribs was complex and did not achieve sufficient improvements in efficiency.

The upper chamber 12 of my press 10 further includes ceramic insulator blocks 46 and 48 which surround the top wall of the steel cover 38. The ceramic insulator block 46 is preferably made of the same hard ceramic material as the ceramic forming chamber 20. There are four ceramic insulator blocks 48, each preferably made of the same lightweight foam ceramic material as the ceramic platen 40. Only one of the ceramic insulator blocks is visible in FIG. 1. There is one ceramic insulator block 48 adjacent each side and edge of the metal sheet 28. A relatively thin steel jacket 50 surrounds the ceramic insulator blocks 46 and 48. The jacket 50 is made of mild steel and is used to hold all of components together. A steel picture frame made of angles 51 is bolted to the jacket 50 for supporting the ceramic insulator blocks 48. A layer of a thin hard insulation material such as 52 is secured to the underside of each of the four ceramic insulator blocks 48.

Vertical bores 53, 54, 56 and 58 extend through the ceramic insulator block 46. The top wall 50*a* of the steel jacket 50 has a plurality of holes 60, 62, 64 and 66 which are aligned with the upper ends of the bores 53, 54, 56 and 58, respectively. A sealed gas line 68 extends through the hole 60 in the top wall 50*a*, through the bore 53 in the ceramic insulator block 46 and connects to a hole 70 in the top wall of the steel cover 38. The gas line 68 is used to introduce Argon gas at a pressure of, for example, 100–300 PSI, for the purpose of forcing the superplastic Titanium sheet downwardly against the contoured upper surface 26*a* of the ceramic forming die 26. A sealed control conduit 72 extends through the hole 62 in the top wall 50*a* of the steel jacket, through the bore 54 in the ceramic insulator block 46 and through a hole 74 in the top wall of the steel cover 38. The control conduit 72 connects to a thermocouple in a probe 76 with a mechanical pressure seal. This probe extends through the ceramic platen 40 and emerges through the underside 40*a* thereof. A sealed electrical connector 78 extends through the hole 64 in the top wall 50*a* of the steel jacket 50, through the bore 56 in the ceramic insulator block 46 and through a hole 80 in the top wall of the steel cover 38. The lower end of the electrical connector 78 connects to a T-shaped conduit 82 which holds conductors (not illustrated) that connect to the opposite ends of the serpentine radiant heating coil 42. Suitable gas lines, control conduits and electrical connectors are commercially available. A plurality of bolts such as 84 extend through holes in L-shaped steel supports 85 which support the peripheral flanges of the steel cover 38. The upper ends of the bolts 84 are threaded into female threaded holes such as 66 in the top wall 50*a*. This arrangement allows thermal expansion and contraction of the steel cover 38 without bending the bolts 84.

A plurality of radiant heating coils such as 88 are secured to the inwardly facing surfaces 48*a* of the ceramic insulator blocks 48. These peripheral radiant heating coils are secured to the ceramic insulator blocks 48 by means of staples 44 in the same manner illustrated in FIG. 2. The purpose of the peripheral radiant heating coils is to heat and soften the peripheral edges of the Titanium sheet 28. This ensures that there will be a gas tight seal formed by squeezing the Titanium sheet between the steel apron 30 and steel cover 38 which has an impinging bead.

The radiant heating coils 42 and 88 can be stretched to provide the desired amount of radiant heating for a given area. It will be understood that the overall configuration of my press 10 is rectangular. Accordingly, there will be four separate radiant heating coils vertically arranged above the side edges and end edges of the Titanium sheet 28. By way of example, each of the coils above the side edges of the sheet may have approximately 17.6 ohms of resistance and may be made of a seventy-two inch length of coiled Nichrome heating wire stretched apart and bent into the desired serpentine configuration. Such a coil dissipates approximately 5,500 watts of power provided at approximately twenty-five amperes and two hundred and twenty volts.

The main radiant heating coil 42 is similarly made of a predetermined length of coiled Nichrome wire and is stretched the required amount in order to provide the necessary amount of heating. The heating must be sufficient to place the majority of the Titanium sheet 28 in a superplastic condition. Suitable high temperature heating coils are commercially available and are sold, for example, under the trademark KANTHAL.

Tests conducted with an SPF press constructed in the manner illustrated in FIG. 1 have indicated that the heat-up time can be reduced by 75% and energy consumption can be reduced by 40% compared to a conventional SPF press. The forming cycle can be reduced by 25% with my invention. The extensive use of ceramic inside the upper and lower chambers of my press results in significant cost savings in the fabrication thereof. The upper and lower ceramic insulator blocks 46 and 48 minimize the transmission of radiant heat to the outer steel jackets. Thus, my press may be considered a "cold wall" press. The construction of my press therefore minimizes heat distortion of the surrounding steel jackets. The die support surface, namely, the horizontal surface of the upwardly opening interior of ceramic forming chamber 20, stays completely flat. Flat ground steel base plates are therefore not required in my SPF press. Both male and female dies can be utilized in my press.

While I have described a preferred embodiment of my cold wall SPF press, it should be understood that modifications and adaptations thereof will occur to persons skilled in the art. For example, the coil heaters could be replaced with silicon carbide bars held to the foam ceramic with suitable fasteners. Suitable bars of this type are sold under the trademark WATCO. The ceramic forming die 26 could be replaced with a steel forming die. Therefore, the protection afforded my invention should only be limited in accordance with the scope of the following claims.

I claim:

1. An apparatus for superplastic forming of a metal sheet, comprising:

a lower chamber including a ceramic forming chamber surrounded by a first outer metal jacket, the ceramic forming chamber having an upwardly opening interior for receiving and supporting a forming die, and a horizontal metal apron surrounding said upwardly opening interior and received within an upwardly facing recess provided in a peripheral upper surface of the ceramic forming chamber;

an upper chamber positioned above the lower chamber, the upper chamber including a downwardly opening metal cover having a plurality of side walls with lower horizontal edges that overlie the apron, a ceramic platen supported within an interior of the steel cover, a radiant heating element mounted on a flat underside of the ceramic platen, a ceramic insulator block above the metal cover, and a second outer metal jacket surrounding the insulator block; and means for vertically reciprocating at least one of the upper and lower chambers to squeeze a plurality of peripheral edges of a metal sheet laid across the interior of the ceramic forming chamber between the apron and the horizontal edges of the metal cover.

2. An apparatus according to claim 1 wherein the ceramic platen is made of a foam ceramic material and the radiant heating element is attached to a flat underside of the ceramic platen with a plurality of fasteners inserted into the ceramic platen.

3. An apparatus according to claim 2 wherein the foam ceramic platen has a maximum density of approximately thirty pounds per cubic foot.

4. An apparatus according to claim 1 and further comprising a plurality of second ceramic insulator blocks made of a foam ceramic material surrounding the metal cover and a plurality of second radiant heating elements mounted to a plurality of inwardly facing surfaces of the second ceramic insulator blocks for heating the peripheral edges of the metal sheet to ensure a gas tight seal between the horizontal edges of the metal cover and the sheet.

5. An apparatus according to claim 1 and further comprising means for introducing a pressurized gas through the upper chamber into the interior of the metal cover.

6. An apparatus according to claim 1 and further comprising means for lifting the metal apron to remove the metal sheet from the forming die.

7. An apparatus according to claim 1 and further comprising a ceramic forming die removeably received in the the upwardly opening interior of the ceramic forming chamber, the ceramic forming die having an upper surface defining the contour of the part to be formed by superplastically forming the metal sheet thereover, and the ceramic forming die having a plurality of bottom and side surfaces which fit snugly against a plurality of bottom and side walls of the upwardly opening interior of the ceramic forming chamber.

8. An apparatus according to claim 1 and further comprising a thermocouple probe extending through the upper chamber into the interior of the metal cover.

9. An apparatus according to claim 1 and further comprising an electrical connector extending through the upper chamber, through the metal cover and into the ceramic platen.

10. An apparatus according to claim 1 and further comprising a plurality of metal reinforcing ribs surrounding the first metal jacket.

11. An apparatus for superplastic forming of a Titanium sheet, comprising:

a lower chamber including a ceramic forming chamber surrounded by a first outer metal jacket, the ceramic forming chamber having an upwardly opening interior for receiving and supporting a forming die, and a horizontal metal apron surrounding said upwardly opening interior and received within an upwardly facing recess provided in a peripheral upper surface of the ceramic forming chamber;

an upper chamber positioned above the lower chamber, the upper chamber including a downwardly opening metal cover having a plurality of side walls with lower horizontal edges that overlie the apron, a foam ceramic platen supported within an interior of the metal cover, a first radiant heating coil mounted on a flat underside of the foam ceramic platen with a plurality of fasteners inserted into the foam ceramic platen, a hard ceramic insulator block above the steel cover, a plurality of foam ceramic insulator blocks surrounding the metal cover adjacent the lower horizontal edges of the side walls of the metal cover, a plurality of second radiant heating coils mounted to the inwardly facing surfaces of the foam ceramic insulator blocks with fasteners, and a second outer metal jacket surrounding the insulator block;

means for vertically reciprocating at least one of the upper and lower chambers to squeeze a plurality of peripheral edges of a Titanium sheet laid across the interior of the ceramic forming chamber between the apron and the horizontal edges of the metal cover; and means for introducing a pressurized gas through the upper chamber into the interior of the steel cover.

12. An apparatus according to claim 2 wherein the foam ceramic platen and foam ceramic insulator blocks have a maximum density of approximately thirty pounds per cubic foot.

13. An apparatus according to claim 11 and further comprising means for lifting the metal apron to remove the Titanium sheet from the forming die.

14. An apparatus according to claim 11 and further comprising a thermocouple probe extending through the upper chamber into the interior of the metal cover.

15. An apparatus according to claim 11 and further comprising an electrical connector extending through the upper chamber, through the metal cover and into the ceramic platen.

16. An apparatus according to claim 11 and further comprising a plurality of metal reinforcing ribs surrounding the first metal jacket.

17. In an apparatus for SPF of a metal sheet, the apparatus having openable upper and lower chambers, the improvement comprising:

a platen mounted in the upper chamber and made of a foam ceramic material;

a radiant heating element; and fastening means for securing the radiant heating element to a surface of the platen for maximizing the amount of heat radiated from the heating element to a metal sheet supported between the chambers adjacent to the heating element.

18. The invention of claim 17 wherein the foam ceramic material has a maximum density of approximately thirty pounds pounds per cubic foot.

19. The invention of claim 17 wherein the fastener means comprise staples inserted into the foam ceramic platen.

20. The invention of claim 17 wherein the electric heating element comprises a Nichrome coiled wire stretched a predetermined amount into a serpentine configuration.

* * * * *